US010026324B2

(12) United States Patent
Shamasundar et al.

(10) Patent No.: US 10,026,324 B2
(45) Date of Patent: Jul. 17, 2018

(54) SYSTEMS AND METHODS FOR ENHANCED ADOPTIVE VALIDATION OF ATC CLEARANCE REQUESTS

(71) Applicant: Honeywell International Inc., Morristown, NJ (US)

(72) Inventors: Raghu Shamasundar, Karnataka (IN); Thomas D. Judd, Woodinville, WA (US)

(73) Assignee: Honeywell International Inc., Morris Plains, NJ (US)

( * ) Notice: Subject to any disclaimer, the term of this patent is extended or adjusted under 35 U.S.C. 154(b) by 218 days.

(21) Appl. No.: 14/532,496

(22) Filed: Nov. 4, 2014

(65) Prior Publication Data

US 2016/0125744 A1 May 5, 2016

(51) Int. Cl.
*G08G 5/00* (2006.01)
*G08G 5/04* (2006.01)

(52) U.S. Cl.
CPC ..... *G08G 5/0039* (2013.01); *G08G 5/0013* (2013.01); *G08G 5/0021* (2013.01); *G08G 5/0091* (2013.01); *G08G 5/04* (2013.01)

(58) Field of Classification Search
CPC .. G08G 5/0039; G08G 5/0013; G08G 5/0021; G08G 5/0091; G08G 5/04
See application file for complete search history.

(56) References Cited

U.S. PATENT DOCUMENTS 3,646,555 A 2/1972 Atlas
3,668,403 A 6/1972 Meilander
3,750,166 A 7/1973 Dearth
4,649,388 A 3/1987 Atlas
4,706,198 A 11/1987 Thurman
4,812,990 A 3/1989 Adams et al.
5,025,382 A 6/1991 Artz
(Continued)

FOREIGN PATENT DOCUMENTS

DE 202006005089 6/2006
EP 0237714 9/1987
(Continued)

OTHER PUBLICATIONS

Berckefeldt, "Automatic Dependent Surveillance—Broadcast (ADS-B) in Trail Procedures (ITP)", "AIAA Aviation Technology, Integration, and Operations Conference", Sep. 17-19, 2012, pp. 131, Publisher: Honeywell, Published in: US.
(Continued)

*Primary Examiner* — Peter D Nolan
(74) *Attorney, Agent, or Firm* — Fogg & Powers LLC

(57) ABSTRACT

Systems and methods for enhanced adoptive validation of ATC clearance requests are provided. In certain implementations, a system comprises a processor executing a controller pilot data link communication application, and at least one source of dynamic information coupled to the processor, wherein the dynamic information comprises data relevant to possible flight paths of an aircraft, the dynamic information being changeable during the flight of the aircraft, wherein the processor processes at least one clearance request that identifies a deviation from the present flight path and validates the at least one clearance request against the dynamic information.

20 Claims, 9 Drawing Sheets

(56) References Cited

U.S. PATENT DOCUMENTS 5,086,396 A 2/1992 Waruszewski, Jr.
5,153,836 A 10/1992 Fraughton et al.
5,526,265 A 6/1996 Nakhla
5,550,742 A 8/1996 Furuya et al.
5,572,428 A 11/1996 Ishida
5,615,118 A 3/1997 Frank
5,631,640 A 5/1997 Deis et al.
5,648,905 A 7/1997 Izumi
5,714,948 A 2/1998 Farmakis et al.
5,754,099 A 5/1998 Nishimura
5,842,142 A 11/1998 Murray et al.
5,884,223 A 3/1999 Tognazzini
5,899,954 A 5/1999 Sato
5,936,552 A 8/1999 Wichgers et al.
5,941,793 A 8/1999 Ito
5,999,882 A 12/1999 Simpson et al.
6,043,756 A 3/2000 Bateman et al.
6,061,627 A 5/2000 Sato
6,097,996 A 8/2000 Deker
6,141,617 A 10/2000 Matsuda
6,160,497 A 12/2000 Clark
6,181,987 B1 1/2001 Deker et al.
6,198,426 B1 3/2001 Tamatsu
6,289,277 B1 9/2001 Feyereisen et al.
6,314,362 B1 11/2001 Erzberger et al.
6,567,727 B2 5/2003 Westphal
6,571,166 B1 5/2003 Johnson et al.
6,604,044 B1 8/2003 Kirk
6,683,541 B2 1/2004 Staggs et al.
6,744,382 B1 6/2004 Lapis et al.
6,828,921 B2 * 12/2004 Brown ..... G08G 5/0086 340/945
6,828,922 B1 12/2004 Gremmert et al.
6,853,906 B1 2/2005 Michi et al.
6,961,661 B2 11/2005 Sekiguchi
7,046,822 B1 5/2006 Knoeppel
7,103,455 B2 9/2006 Subelet
7,129,857 B1 10/2006 Spirkovska
7,243,026 B2 7/2007 Kudo
7,272,482 B2 9/2007 Kubota
7,737,867 B2 7/2010 Arthur et al.
7,979,199 B2 * 7/2011 Judd ..... G08G 5/0013 244/17.13
8,229,659 B2 * 7/2012 Judd ..... G08G 5/0013 701/120
8,423,272 B2 * 4/2013 Judd ..... G08G 5/0013 701/120
8,554,394 B2 10/2013 Shamasundar
8,660,713 B2 2/2014 Khatwa et al.
9,349,295 B2 * 5/2016 Dorneich ..... G08B 21/06
2001/0014846 A1 8/2001 Sawamoto
2001/0018641 A1 8/2001 Kodaka
2002/0133285 A1 9/2002 Hirasago
2003/0122701 A1 7/2003 Tran
2003/0158666 A1 8/2003 Koike
2003/0193408 A1 * 10/2003 Brown ..... G08G 5/0086 340/945
2003/0204298 A1 10/2003 Ahmed-Zaid
2003/0210807 A1 11/2003 Sato
2004/0143393 A1 7/2004 Knecht et al.
2004/0158377 A1 8/2004 Matsumoto
2004/0193347 A1 9/2004 Harumoto
2004/0254729 A1 12/2004 Browne
2005/0004762 A1 1/2005 Takahama
2005/0049762 A1 * 3/2005 Dwyer ..... G08G 5/0021 701/3
2005/0080565 A1 4/2005 Olney
2005/0203675 A1 9/2005 Griffin, III et al.
2006/0212180 A1 9/2006 Saffre
2006/0267748 A1 11/2006 Knoop
2006/0267829 A1 * 11/2006 Brandao ..... G01S 13/765 342/29
2007/0050101 A1 3/2007 Sacle et al.
2007/0129854 A1 6/2007 Sandell et al.
2007/0129855 A1 6/2007 Coulmeau
2007/0142981 A1 6/2007 Gutierrez-Castaneda et al.
2007/0189328 A1 8/2007 Judd
2007/0219679 A1 * 9/2007 Coulmeau ..... G08G 5/0039 701/3
2008/0010005 A1 1/2008 Small et al.
2008/0167885 A1 * 7/2008 Judd ..... G08G 5/0013 701/120
2008/0306691 A1 * 12/2008 Louis ..... G08G 5/06 701/301
2009/0179114 A1 7/2009 Conner
2010/0121575 A1 * 5/2010 Aldridge ..... G08G 5/0069 701/301
2010/0332054 A1 * 12/2010 Brandao ..... G08G 5/0013 701/3
2011/0246053 A1 10/2011 Coulmeau et al.
2011/0257874 A1 * 10/2011 Judd ..... G08G 5/0013 701/122
2012/0078448 A1 * 3/2012 Dorneich ..... G08B 21/06 701/3
2012/0277986 A1 * 11/2012 Judd ..... G08G 5/0013 701/122
2013/0080043 A1 * 3/2013 Ballin ..... G08G 5/0034 701/120

FOREIGN PATENT DOCUMENTS

EP 2159544 3/2010
EP 2267683 12/2010
WO 9519547 7/1995
WO 02099769 12/2002

OTHER PUBLICATIONS

European Patent Office, "Extended European Search Report from European application No. 15192474.3", "from foreign counterpart of U.S. Appl. No. 14/532,496", dated Mar. 21, 2016, pp. 1-7, Published in: EP.
European Patent Office, "Extended European Search Report for EP Application No. 16199746.5", "Foreign Counterpart to U.S. Appl. No. 11/621,653", dated Mar. 24, 2017, pp. 1-11, Published in: EP.
Dickinson, Gary W., "Feasibility Study of ATN Baseline 1 Avionics Use for U.S. Oceanic Air Traffice Control Operations", "Digital Avionics Systems Conferences 2000", Oct. 7, 2000, pp. 7.E.5_1-7.E.5_7, vol. 2, publisher: IEEE, Published in: Piscataway, NJ, USA.
Wu et al., "Impact of Controller-Pilot Data Link Communications on Oceanic ATC Service", "[Digital Avionics Systems Conference]", Oct. 27-31, 2002, pp. 1_c_1_1-1_c_1_10, vol. 1, Publisher: 21th. DASC. The Th. Digital Avionics Systems Conference Proceedings. IEEE, Published in: Irvine, CA.
European Patent Office, "European Search Report for EP Application No. 08100228.9", "Foreign Counterpart to U.S. Appl. No. 11/621,653", dated May 23, 2008, pp. 1-8, Published in: EP.
European Patent Office, "Communication Pursuant to Article 94(3) for EP Application No. 08100228.9", "Foreign Counterpart to U.S. Appl. No. 11/621,653", dated Oct. 12, 2010, pp. 17, Published in: EP.
United States Patent and Trademark Office, "Advisory Action", "From U.S. Appl. No. 11/621,653", dated May 6, 2010, pp. 1-3, Published in: US.
United States Patent and Trademark Office, "Final Office Action", "From U.S. Appl. No. 11/621,653", dated Feb. 19, 2010, pp. 1-20, Published in: US.
United States Patent and Trademark Office, "Notice of Allowance", "From U.S. Appl. No. 11/621,653", dated Apr. 4, 2011, pp. 1-10, Published in: US.
United States Patent and Trademark Office, "Office Action", "From U.S. Appl. No. 11/621,653", dated Sep. 3, 2009, pp. 1-23, Published in: US.
United States Patent and Trademark Office, "Notice of Allowance", "From U.S. Appl. No. 13/151,852", dated Apr. 11, 2012, pp. 1-10, Published in: US.

(56) References Cited

OTHER PUBLICATIONS

United States Patent and Trademark Office, "Office Action", "From U.S. Appl. No. 13/151,852", dated Dec. 16, 2011, pp. 1-18, Published in: US.
United States Patent and Trademark Office, "Notice of Allowance", "From U.S. Appl. No. 13/528,360", dated Dec. 26, 2012, pp. 1-10, Published in: US.
United States Patent and Trademark Office, "Office Action", "From U.S. Appl. No. 13/528,360", dated Sep. 13, 2012, pp. 1-18, Published in: US.
Fan et al., "Study of In-Flight Replanning Decision Aids", "Proceedings of AIAA Guidance, Navigation and Control Conference", 1998, pp. 980-988, Publisher: American Institute of Aeronautics and Astronautics, Inc., Published in: Boston, MA.
Yueh-Shiou Wu et al., "Impact of Controller-Pilot Data Link Communications on Oceanic ATC Service,""The 21st Digital Avionics Systems Conference Proceedings", Oct. 27, 2002, pp. 1.C.1_1-1.C.1_10, vol. 1, Publisher: IEEE, Published in: New York, NY, USA.
European Patent Office, "Office Action from EP Application No. 15192474.3, dated Jun. 16, 2017", "from Foreing Counterpart of U.S. Appl. No. 14/532,496", dated Jun. 16, 2017, pp. 1-5, Published in: EP.

* cited by examiner

SYSTEMS AND METHODS FOR ENHANCED ADOPTIVE VALIDATION OF ATC CLEARANCE REQUESTS

BACKGROUND

Generally, flight crews operate airplanes and other airborne vehicles according to a flight plan that is generated based on a destination, weather, terrain, and other factors. After a flight commences, unforeseen situations may arise that may necessitate a change in the flight plan. The situations that may cause changes in the flight plan may include route availability, altitude availability, weather, and other potential flight conflicts. The flight crew and the air traffic controller are responsible for determining how to change the flight plan in response to the unforeseen situations.

Currently, to change the flight plan, the flight crew may populate a CPDLC message with a request to change the flight plan and then send the CPDLC message to the air traffic controller through a downlink. Whereupon the flight crew waits for the air traffic controller to send an uplink approving the flight plan change. When populating the CPDLC message, the flight crew may validate the flight plan change against static information stored within databases on the aircraft. For example, the flight crew may check that the proposed flight plan change is within a range of statically defined flight paths. However, the proposed flight path changes may be rejected by the air traffic controller causing the flight crew to propose a different change to the flight plane. The proposal of multiple changes to the flight plan may consume both the time of the pilot and the air traffic controller, when they could be using their time more efficiently by performing multiple tasks. Further, the proposed flight path changes, even if approved by the air traffic controller, may ignore possibly better flight path changes.

SUMMARY

Systems and methods for enhanced adoptive validation of ATC clearance requests are provided. In certain implementations, a system comprises a processor executing a controller pilot data link communication application, and at least one source of dynamic information coupled to the processor, wherein the dynamic information comprises data relevant to possible flight paths of an aircraft, the dynamic information being changeable during the flight of the aircraft, wherein the processor processes at least one clearance request that identifies a deviation from the present flight path and validates the at least one clearance request against the dynamic information.

DRAWINGS

Understanding that the drawings depict only exemplary embodiments and are not therefore to be considered limiting in scope, the exemplary embodiments will be described with additional specificity and detail through the use of the accompanying drawings, in which.

Figure 1:
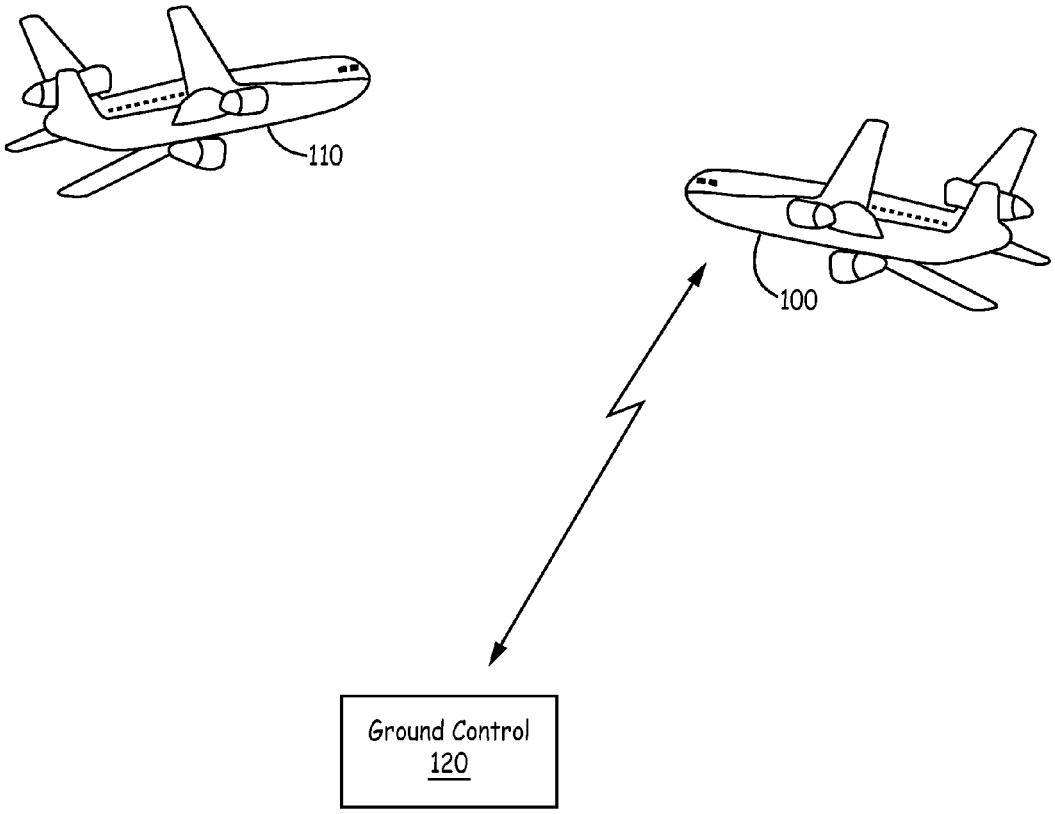
FIG. 1 is a drawing illustrating aircraft communication in one embodiment described in the present disclosure.

In accordance with common practice, the various described features are not drawn to scale but are drawn to emphasize specific features relevant to the exemplary embodiments.

DETAILED DESCRIPTION

In the following detailed description, reference is made to the accompanying drawings that form a part hereof, and in which is shown by way of illustration specific illustrative embodiments. However, it is to be understood that other embodiments may be utilized and that logical, mechanical, and electrical changes may be made. Furthermore, the method presented in the drawing figures and the specification is not to be construed as limiting the order in which the individual steps may be performed. The following detailed description is, therefore, not to be taken in a limiting sense.

Systems and methods for enhanced adoptive validation of air traffic controller (ATC) clearance requests are describe herein. In particular, when validating an ATC clearance request before the transmission of the clearance request to the ATC, the controller pilot data link communication system validates the clearance request against dynamic data available to the flight crew. By using dynamically available data, the clearance request will have an increased chance of being approved by the ATC, thus decreasing the amount of possible communications between the flight crew and the ATC. Further, the pilots can have increased confidence that the validated clearance request represents a best possible deviation from the previous flight plan.

FIG. 1 illustrates a diagram of an aircraft 100 that uses adoptive validation of ATC clearance requests to deviate from a flight plan. In at least one implementation, aircraft 100 may be any airborne vehicle, such as a jet, a helicopter, or the like. The aircraft includes a system that generates clearance requests to deviate from a flight plan in response to changes in the environment along the previously determined flight path. In this exemplary implementation, airplane 100 is on a path that passes close to airplane 110. Systems on the airplane 100 notify either the flight crew or a CPDLC application that a situation has arisen that may be remediated through a change in the flight plan. As used herein, changes in flight plan may include waypoint changes, altitude changes, velocity changes, direction changes, and the like. For example, a traffic-alert and collision avoidance system (TCAS) may provide an indication that another airplane 110 is on the flight path. In response to the notification from the TCAS, the CPDLC application, flight crew member, or other application may determine a change in the flight plan to avoid the airplane 110. Whether a flight crew member, or the CPDLC application creates the potential clearance request, a flight crew member reviews the clearance request message and decides whether or not to send the clearance request to the ATC at the ground control 120.

If the flight crew member decides to approve the clearance request, the clearance request is validated against FMS and/or flight traffic and/or and weather radar before being transmitted to the ground control 120. When validating the clearance request, the CPDLC application validates the clearance request against static databases and against dynamic information available from multiple different data sources as described in greater detail below. When the clearance request is validated, the CPDLC application determines that the clearance request is associated with a viable variance to the flight plan. For example, the CPDLC application determines that the proposed change to the flight plan would be safe and does not conflict with any of the dynamic information. The CPDLC application may also determine whether the change is economical. Further, the CPDLC application may provide the flight change along with an advisory to contact the ATC center for approval.

If the change is validated, the flight crew may decide to transmit the clearance request from the aircraft 100 to the ground control 120 through a downlink. If the ATC in the ground control 120 allows the change in the flight plan, an uplink of a confirmation of the clearance request is sent via an air-to-ground wireless network from the ground control 120 to the CPDLC application on the aircraft 100. By validating the clearance request against both the static and dynamic information, the likelihood that the ATC will approve the request is increased, however, if the ATC in the ground control 120 rejects the change in the flight plan, an uplink of the rejection of the clearance request is sent from the ground control 120 to the CPDLC application on the aircraft 100.

In at least one further embodiment, the CPDLC application may identify one or more different clearance requests based on the dynamic information and present the already validated clearance requests to the user for transmission to the air traffic controller. In particular, when more than one possible clearance request is presented to the user, the user may select one of the clearance requests for transmission to the air traffic controller. Further, certain clearance requests may be validated based on automatic dependent surveillance-broadcast (ADS-B) data. When a clearance request is validated based on ADS-B data, the CPDLC application may also construct a message for transmission to the air traffic controller describing the ADS-B data. Messages associated with sources of dynamic information other than ADS-B data may also be constructed for transmission to the air traffic controller.

Figure 2:
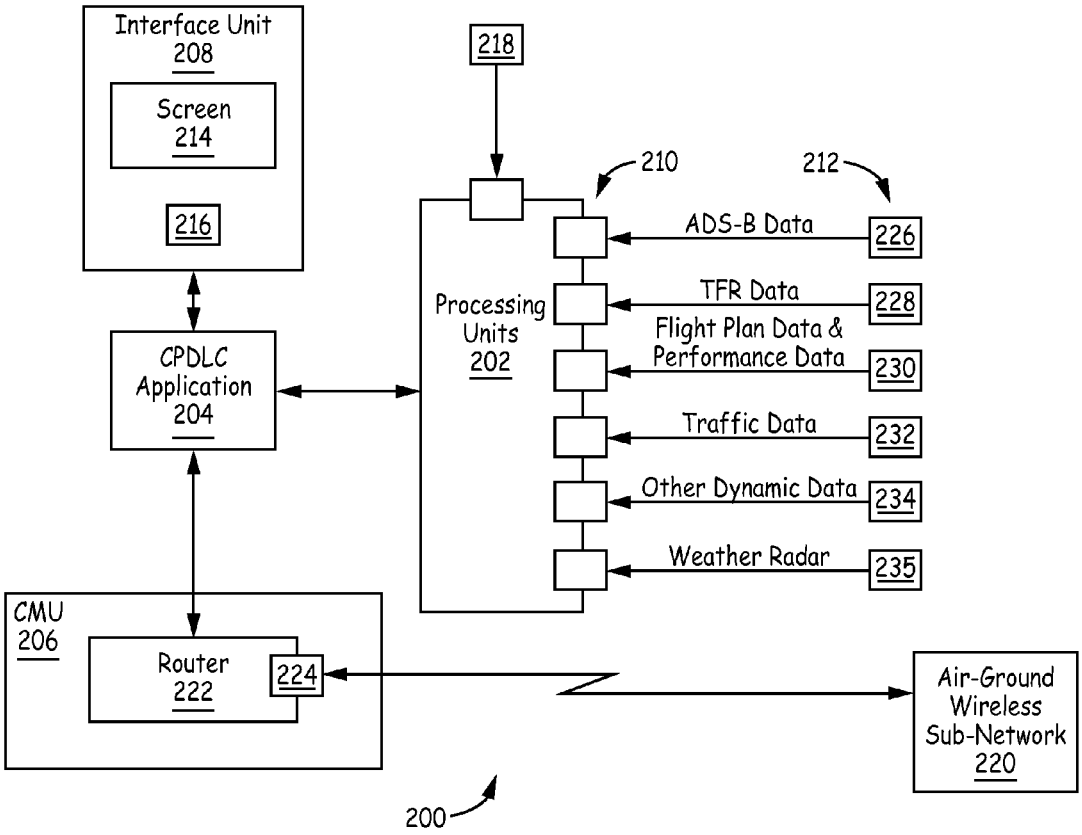
FIG. 2 is a block diagram illustrating a system for validating clearance requests in one embodiment described in the present disclosure.

FIG. 2 is a block diagram of one embodiment of a system 200 that provides adoptive validation of ATC clearance requests. System 200 includes a processing units 202, a controller/pilot data link communications (CPDLC) application 204, a communications management unit (CMU) 206, an interface unit 208, and at least one interface represented generally by the numeral 210. The interfaces 210 communicatively couple the processing units 202 to at least one dynamic source of validation data represented generally by the numeral 212 and at least one static source of validation data represented generally by the numeral 218. As used herein, the term "communications management unit" refers to a device or unit that manages the communications between the aircraft 100 and the ground control 120 as described above in relation to FIG. 1.

In one implementation of this embodiment, the processor is a controller/pilot data link communication (CPDLC) validation processor. The terms "processing units 202" and "CPDLC validation processor 202" are used interchangeably herein. In one implementation of this embodiment, the CPDLC validation processor 202 is integrated with one or more other processors within the aircraft 100 (FIG. 1). For example, the processing units 202 may include a single processor or a distributed processor, where each processor operates to validate clearance requests against alternative sources. The CPDLC validation processor 202 interacts with inputs from validation information from the dynamic sources 212, static sources 218 and the CPDLC application 204, to determine that a proposed deviation from a flight plan is valid. When the processing units 202 determines that a proposed deviation is valid, the CPDLC application 204 provides a CPDLC clearance request proposing a deviation from the flight plan to the CMU 206.

As shown in FIG. 2, the interface unit 208 includes a screen 214 on which to visually indicate the prompt to the user, such as the pilot of the aircraft 100. Initially, a proposed clearance request is displayed on the screen 214. In certain implementations, the proposed clearance request is provided as described in U.S. Pat. No. 7,979,199, titled "METHOD AND SYSTEM TO AUTOMATICALLY GENERATE A CLEARANCE REQUEST TO DEVIATE FROM A FLIGHT PLAN," which is hereby incorporated by reference. Upon viewing that a clearance request is available for transmission, as indicated on the screen 214, a flight crew member requests validation of the clearance request. As shown in FIG. 2, the interface unit 208 also includes a user input interface 216 to receive commands from a flight crew member. In one implementation of this embodiment, the interface unit 208 is a human-machine interface. The user input interface 216 receives a command to validate a clearance request from a flight crew member in response to the display of the clearance request. The user input interface 216 may receive the validation command via programmable buttons, a touch screen, a cursor, voice commands, or other means for communicating data from a user to computer.

In one implementation of this embodiment, the user input interface is a tactile input interface 216 such as one or more push buttons or a joy stick. For example, the tactile input interface 216 may include a series of push buttons, where each of the push buttons may be associated with a field on the screen 214, where the field is defined by the CPDLC application 204. When a user presses a button on the interface 216, the interface unit 208 creates a signal that generates an event that is handled by the CPDLC application 204. For example, when a clearance request is displayed on the interface unit 208, a defined field stating "VALIDATE" may be associated with one of the buttons such that, when a user presses the button associated with the "VALIDATE" field, the CPDLC application 204 sends the clearance request to the processing units 202, where the processing units 202 uses the inputs from the various dynamic sources 212 and static sources 218 to determine that the deviation from the flight plan described in the clearance request is valid. In an alternative implementation of this embodiment, the user input interface 208 may be an audio input interface such as a microphone/receiver to receive verbal input. For example, a flight crew member may state "VALIDATE CLEARANCE REQUEST" and the interface unit 208 may recognize that statement as an instruction to validate the clearance request as described above. In yet another implementation of this embodiment, the interface unit may provide both a tactile and audio user interface. In yet another implementation of this embodiment, the input interface 208 is a multi-purpose control and display unit (MCDU) human/machine interface device or a multifunction display (MFD).

The interface unit 208 is communicatively coupled to send information from the flight crew to the CPDLC application 204. The CPDLC application 204 controls the communications between the flight crew (e.g., pilot) and ground control 120 (FIG. 1). There are at least two types of CPDLC applications 204 currently in use. One type of CPDLC application 204 is a future air navigation system (FANS) version designed to go over an aircraft communications addressing and reporting system (ACARS). The second type of CPDLC application 204 is designed to go over an aeronautical telecommunications network (ATN). The CPDLC application 204 can reside in either a flight management computer or the CMU 206. To send the validated clearance request to the ground control 120 (FIG. 1) through a downlink, the CPDLC application 204 runs as is understood by one having ordinary skill in the art. Eventually, the ground control 120 responds to the clearance request by either granting or denying clearance. In an alternative implementation of this embodiment, the CPDLC application 204 resides in another device, such as an air traffic service unit (ATSU). In yet another implementation of this embodiment, the flight management computer or the CMU 206 are in integrated boxes that include a communication management function and/or flight management function. The ATN and ACARS are subnetworks, such as an air-to-ground wireless sub-network 220, that provide access for uplinks (going to the aircraft from the ground) and downlinks (going from the aircraft to the ground).

The CMU 206 is communicatively coupled to the CPDLC application 204 to receive information indicative of the clearance request after the clearance request to deviate from a flight plan is approved by the user. The CMU 206 includes some datalink (air-to-ground data communications) applications, but its primary function is that of router for datalinking between the aircraft 100 (FIG. 1) and the ground control 120 (FIG. 1) via ACARS or ATN networks. As shown in FIG. 2, the CMU 206 includes a router 222, also referred to herein as ATN/ACARS air-to-ground router 222. The router 222 includes a wireless interface 224 to communicatively couple the router 222 to an air-to-ground wireless sub-network 220. The signals indicative of the clearance request to deviate from a flight plan are sent from the wireless interface 224 to the ground control 120 via the air-to-ground wireless sub-network 220.

Various dynamic sources 212 provide input to the processing units 202 via the interfaces 210. For example in one implementation of this embodiment, an ADS-B system 226 provides dynamic data describing the positions and headings of aircraft that are within communication distance of the aircraft 100 (FIG. 1) to the processing units 202 via one of the interfaces 210. When clearance requests are validated based on ADS-B data, the CPDLC application 204 may also construct a message for transmission to the air traffic controller describing the ADS-B data such as the positions of other aircraft in the environment of the aircraft. In another implementation of this embodiment, a traffic-alert and collision avoidance system (TCAS) 232 provides TCAS input to the processing units 202 via another one of the interfaces 212. In yet another implementation of this embodiment, flight plan data and performance data 230 may provide various informational data related to the flight path of the aircraft 100. For example the flight plan data and performance data 230 may include systems that provide a digital notice to airman (D-NOTAM), digital terminal weather information for pilots, are part of providing digital flight information services (D-FIS), or are part of providing a digital automatic terminal information service (D-ATIS). In yet another implementation of this embodiment, a flight restriction system 228 may provide information regarding temporary flight restrictions (TFR). Also, clearance requests may be validated against information provided by a weather radar 235 or information charts stored on an electronic flight bag. Further, other dynamic sources of validation information provide other input to the processing units 202 via one of the interfaces 220.

In certain embodiments, when using the information provided by the dynamic sources 212, the processing units 202 validates the information in the clearance request against information provided by the dynamic validation sources 212. Further, the processing units 202 also validates the information against static sources 218 that are stored in memory located on the aircraft 100. In at least one alternative implementation, the CPDLC application 204 generates one or multiple valid clearance requests based on the dynamic data and presents the possible one or more clearance requests to the user through the interface unit 208, where upon the user may select the desired clearance request for transmission to the ground control (120). By validating the information in the clearance request against both information provided by the dynamic validation sources 212 and the static sources 218, the chance that the ground control 120 approves the clearance request may be increased and the greater the confidence that the deviation associated with the clearance request represents a best possible alternative to the current flight path.

Figure 3:
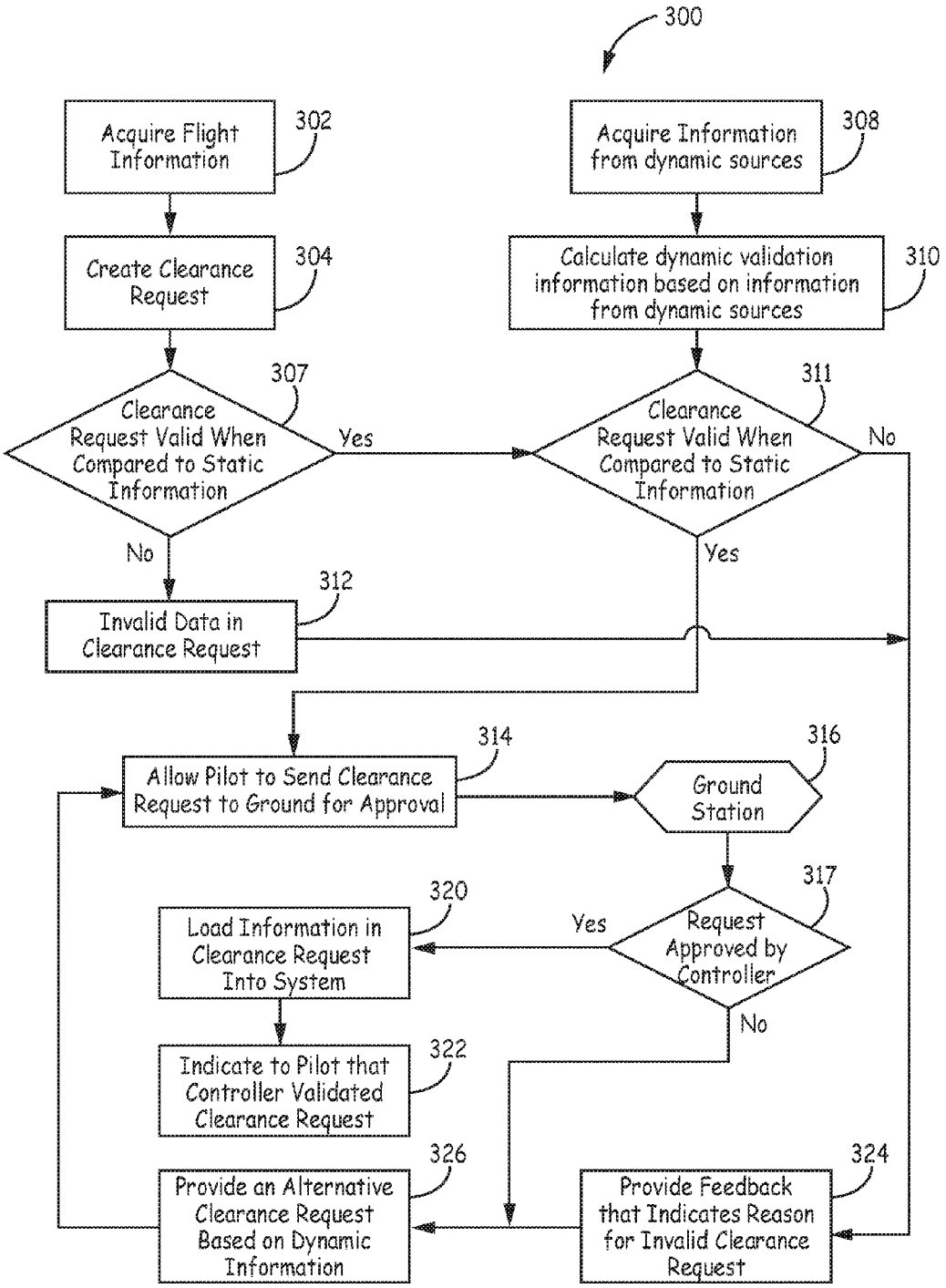
FIG. 3 is a flow diagram of a method for validating clearance requests in one embodiment described in the present disclosure.

FIG. 3 is a flow diagram of a method 300 for creating and validating a clearance request and sending the clearance request to an air traffic controller for approval. Method 300 proceeds at 302, where flight information is acquired. For example, flight information may include data regarding the present environment of an aircraft and may describe conditions along the flight path. At times, the flight information may indicate that conditions along the flight path or other factors exist that indicate that a change to the flight plan of the aircraft becomes advisable. In certain circumstances, these conditions may include other aircraft moving along the flight path, turbulence, weather conditions, arrival time changes, aircraft operation, and the like.

In at least one implementation, when the flight information indicates that a deviation from the flight plan is advisable, the method 300 proceeds at 303, where a clearance request is created. In certain implementations, the clearance request is a CPDLC message from the flight crew requesting clearance to perform a defined deviation from the flight plan, where the clearance request describes the defined deviation. In at least one implementation, the defined deviation describes a new waypoint, a change in altitude, a change in speed, and the like.

In a further implementation, method 300 proceeds at 308, where information is acquired from dynamic sources. As illustrated, the acquisition of data from dynamic sources may be performed concurrently with the acquisition of flight information and the creation of clearance requests. In at least one embodiment, the sources of flight information may also include the sources of information from dynamic sources and vice versa. As described above, sources of dynamic information may include an ADS-B system, a traffic-alert and collision avoidance system (TCAS), a digital notice to airman (D-NOTAM), digital terminal weather information for pilots, digital flight information services (D-FIS), digital automatic terminal information service (D-ATIS), temporary flight restrictions (TFR), four dimensional separation data, and the like. The method 300 proceeds at 310, where dynamic validation information is calculated based on information from the dynamic sources. For example, the information from the dynamic sources may be used to determine valid ranges for any changes to the flight plan.

When the clearance request is created, the method 300 proceeds to 307, where a system determines if a clearance requests is valid when compared to static information. For example, the system may validate the range and format of the clearance request and also validate the clearance request by comparing the clearance request against a pilot defined database. If the clearance request is determined to be invalid, the method 300 proceeds to 312 where the data in the clearance request is determined to be invalid. When the data is determined to be invalid, the system may attempt to determine another clearance request from the acquired information by returning to 302. Alternatively, method 300 may proceed to 324 where feedback is provided to the user that indicates a reason for the invalid clearance request. After or concurrently with the validation against the static data, the method 300 proceeds to 311, where the system determines if the clearance request is valid when compared to dynamic information. If the clearance request is deemed valid when compared against the information from both the static and dynamic sources of information, the method 300 proceeds at 314, where the clearance request is sent to the ground station 316 for approval. In at least one implementation, a flight crew member may edit the clearance request before it is sent to ground for approval. If the clearance request fails the dynamic validation, the method 300 proceeds to 324 where feedback is provided to the user that indicates a reason for the invalid clearance request. For example, a message indicating invalidity may be displayed on a user interface unit. In at least one implementation, the message indicating invalidity is accompanied by an error code to help debug the problem. Further, the method 300 proceeds at 326, where an alternative clearance request is provided, where the alternative clearance request is based on the dynamic information. The method 300 then proceeds at 314, where the alternative clearance request is sent to the ground station 316 for approval.

In further embodiments, when an air traffic controller at the ground station 316 approves the clearance request at 317, the method 300 proceeds at 320, where information in the clearance request is loaded into the system. For example, the deviation from the flight plan is loaded into the system to create a new flight plan. Further, the method 300 proceeds at 322 where an indication that the controller validated the clearance request is provided to the pilot. In certain implementations, if the clearance request is not approved by the controller, the method 300 may proceed to 326, which functions as described above. As described above, the method 300 provides clearance requests that are more responsive to the environment around the aircraft.

FIGS. 4-9 illustrate various user screens that may be displayed on a screen 214 of a user interface unit 208 (described in relation to FIG. 2). As shown in embodiments described herein, FIGS. 4-9 show an interface unit that comprises a Control Display Unit (CDU) 400, such as a Multipurpose Control Display Unit (MCDU) having a display area 415, a plurality of programmable buttons 420 on either side of the display area 415, and a keyboard interface 420. In one embodiment, the common display device user interface unit 208 comprises a MFD which presents the flight crew with a graphical representation having the "look and feel" of an MCDU such as shown in FIGS. 4-9.

Figure 4:
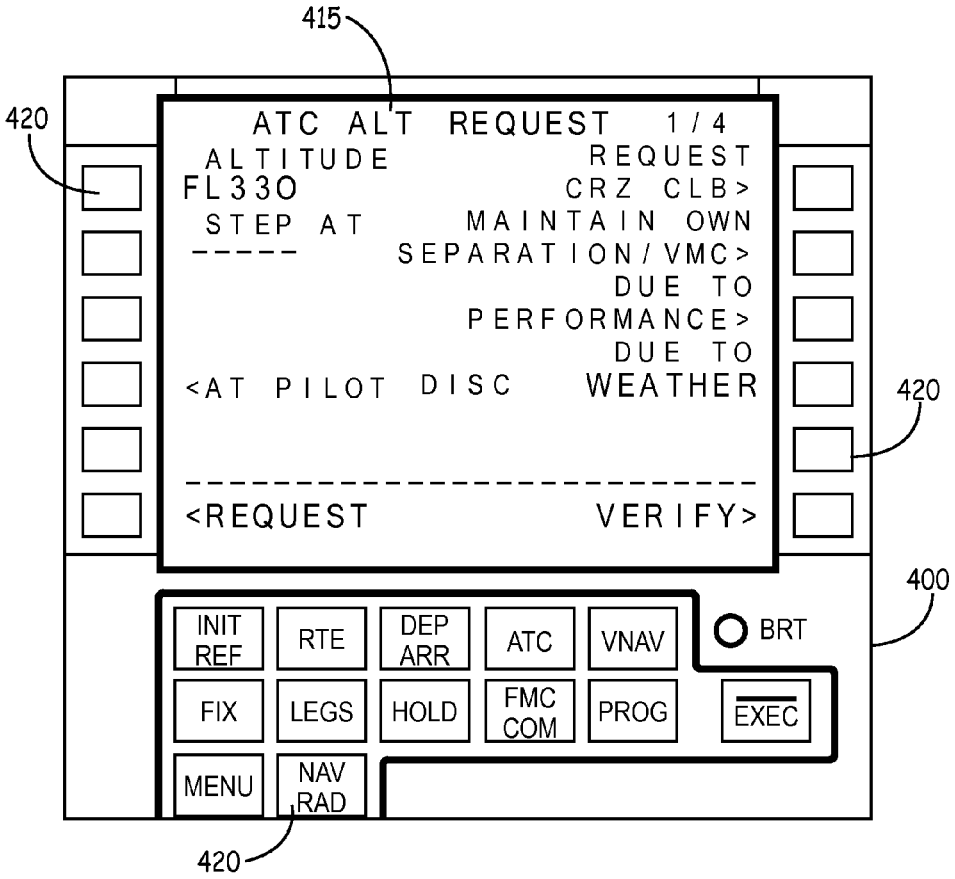
FIGS. 4-8 are examples of possible displays on a human machine interface in multiple embodiments described in the present disclosure.
Figure 5:
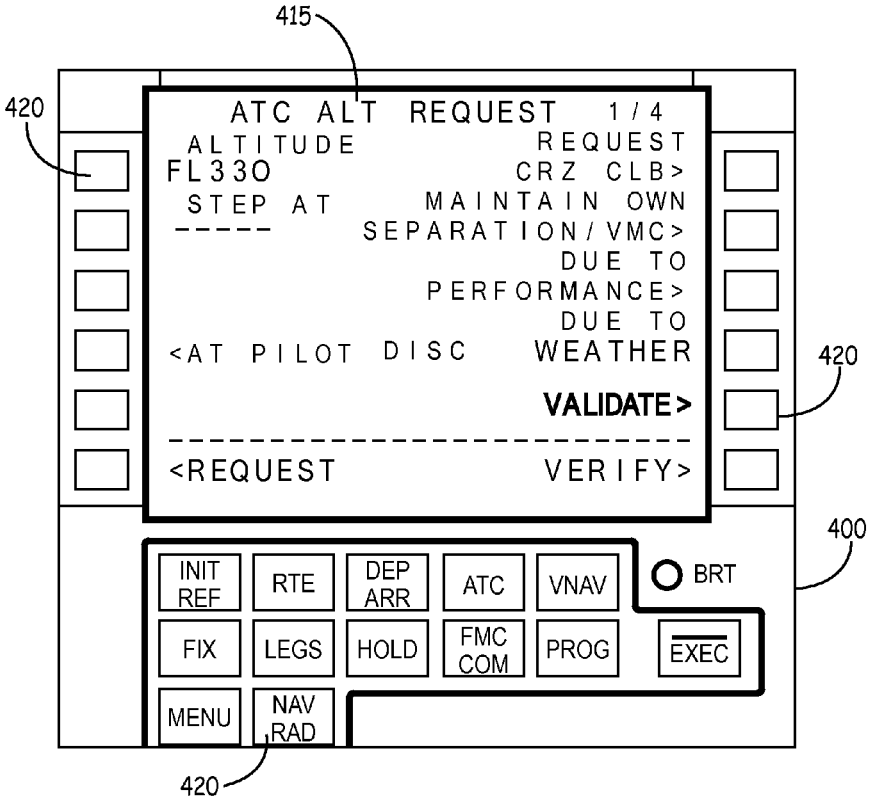

FIG. 4 illustrates a screen from a prior art embodiment showing a possible clearance request to be sent to an air traffic controller. As illustrated, the clearance request is asking permission from the traffic controller to move to flight level 330. The pilot may send the clearance request and await the reception of a message from the air traffic controller approving the reception. However, the air traffic controller may reject the clearance request. To avoid the rejection of a clearance request and to save time for both the pilot and the air traffic controller, the pilot may validate the clearance request before transmitting the clearance request to the air traffic controller. For example, FIG. 5 illustrates an exemplary screen 415 showing a clearance request and the ability to validate the clearance request before transmission to the air traffic controller. As illustrated one of the programmable buttons 420 is configured to allow the pilot to select the validation of the clearance request.

Figure 6:
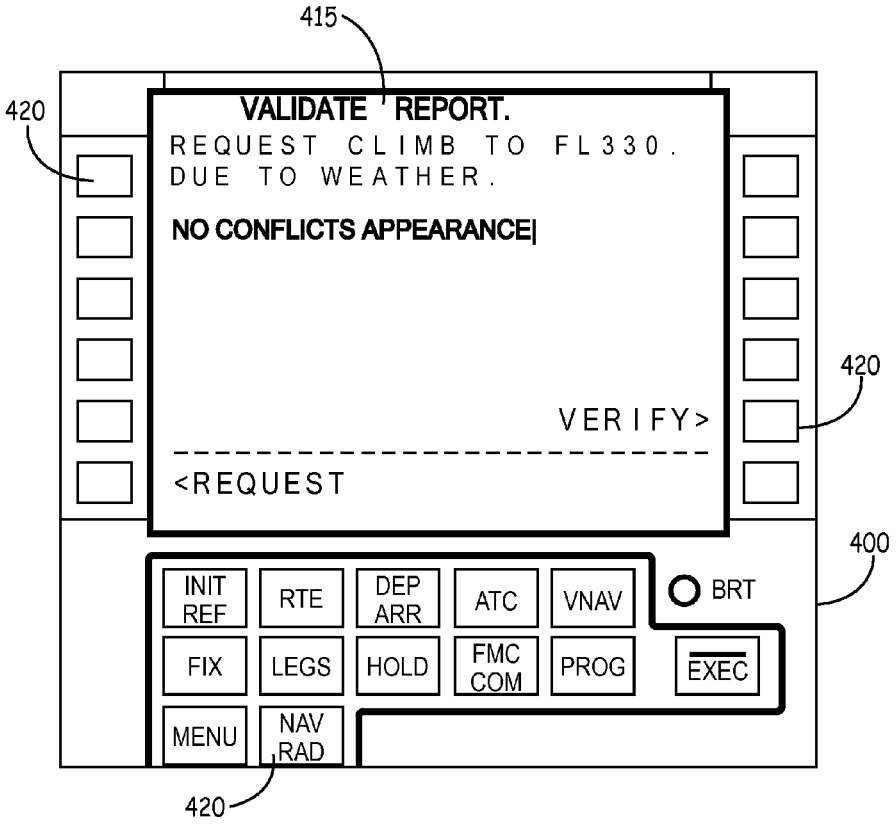
Figure 7:
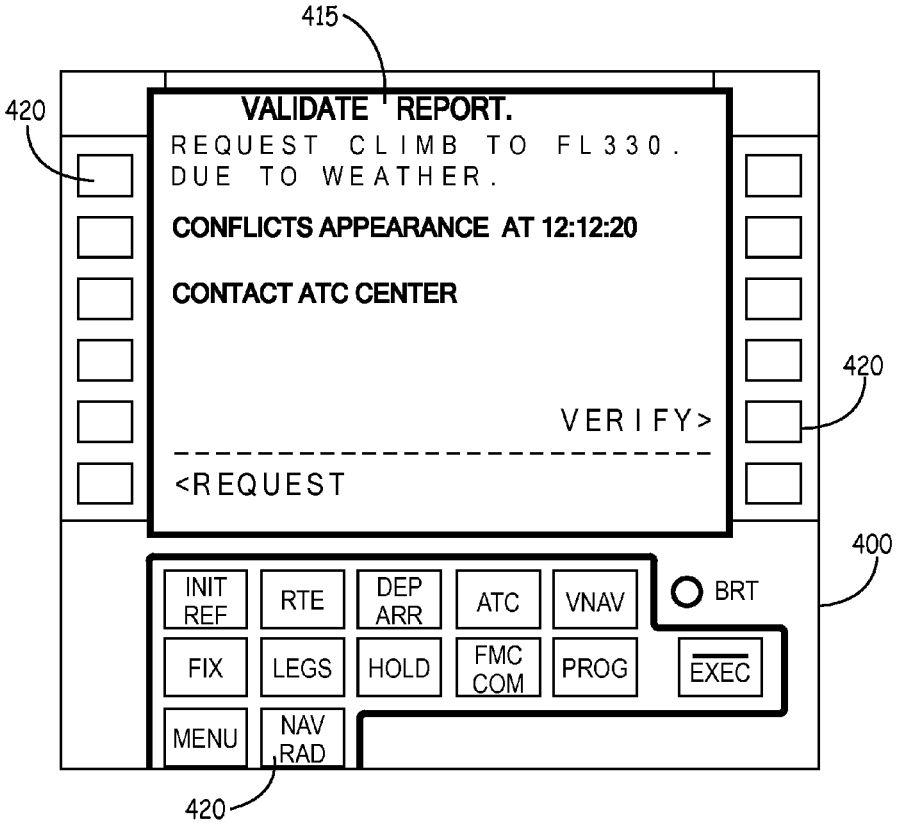
Figure 8:
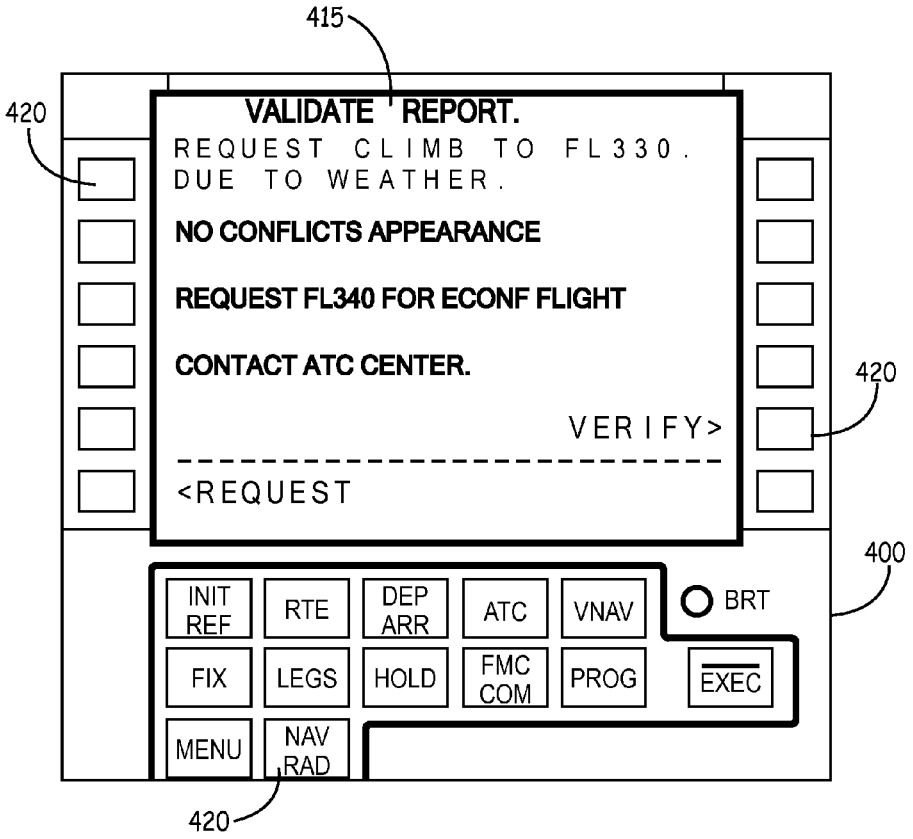

Upon selection of the "Validate" option, the processing units 202 compares the clearance request against dynamic sources of information and if the clearance request is validated, the processing units 202 returns a screen that is exemplified by FIG. 6, which shows a message 415 that indicates that no conflicts appear between the clearance request and the dynamic sources of information. Alternatively, the clearance request may be validated automatically without affirmatively selecting validate. For example, the clearance request may be validated when the clearance request is created, the sending of the clearance request is selected, or verified (e.g., Verify is selected) as compared to a flight crew member explicitly selecting validation through the HMI VALIDATE button selection. When the clearance request is validated, a user may select one of the programmable buttons 420 to send the clearance request to the air traffic controller. In contrast to FIG. 6, FIG. 7 illustrates an embodiment where the clearance request is not validated when compared against the dynamic sources by the processing units 202. As shown, the screen states that a conflicts appearance exists at 12:12:20 and that the ATC center should be contacted to make any adjustments to the flight plan. In an alternative implementation, when a conflict arises, the processing units 202 may calculate and provide a new clearance request for the user to send to the air traffic controller. For example, FIG. 8 illustrates a screen where the processing units 202 identified a new clearance request based on the dynamic sources of data and then suggests that the new clearance request be approved by the air traffic controller. As described above, comparing the clearance request against the dynamic sources of data aids in providing a clearance request that is more likely to be approved by an air traffic controller.

Figure 9:
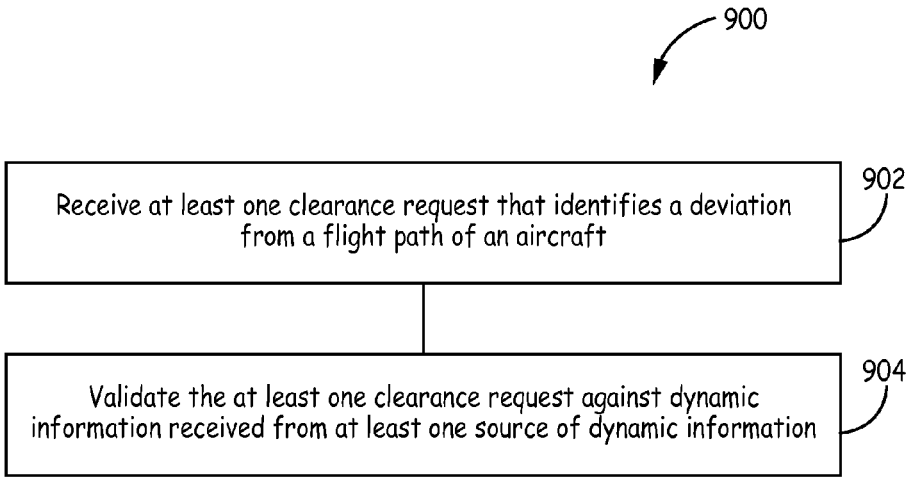
FIG. 9 is a flow diagram of a method for validating clearance request in at least one embodiment described in the present disclosure.

FIG. 9 is a flow diagram of a method 900 for validating a clearance request. In at least one implementation, method 900 proceeds at 902, where at least one clearance request is received that identifies a deviation from a flight path of an aircraft. For example, a processor executing a CPDLC application may determine from multiple sources of information that a situation has arisen that prevents an aircraft from following a flight path. Accordingly, the processor calculates a deviation from the original flight path and forms a clearance request that describes the deviation from the flight path. Method 900 then proceeds at 902, where the at least one clearance request is validated against dynamic information received from at least one source of dynamic information. For example, a flight crew member may direct the processor to validate the clearance request by comparing the deviation associated with the clearance request against the dynamic information. When the processor determines that the clearance request is valid in light of the dynamic information, the clearance request may be sent to an air traffic controller for approval.

Example Embodiments

Example 1 includes a system, the system comprising: a processor executing a controller pilot data link communication application; at least one source of dynamic information coupled to the processor, wherein the dynamic information comprises data relevant to possible flight paths of an aircraft, the dynamic information being changeable during the flight of the aircraft, wherein the processor processes at least one clearance request that identifies a deviation from the present flight path and validates the at least one clearance request against the dynamic information.

Example 2 includes the system of Example 1, wherein the at least one source of dynamic information comprises at least one of: ADS-B data; temporary flight restriction data; traffic-alert and collision avoidance system information; a digital notice to airman; digital flight information services; digital terminal weather information for pilots; weather forecast; a digital automatic terminal information service; or a current flight plan.

Example 3 includes the system of Example 2, wherein the at least one source of dynamic information comprises the ADS-B data, forming a CPDLC message to communicate the ADS-B data to an air traffic controller.

Example 4 includes the system of any of Examples 1-3, wherein validating the at least one clearance request comprises determining that the deviation from the flight plan is allowed in light of the dynamic information.

Example 5 includes the system of any of Examples 1-4, further comprising a user interface coupled to the processor, wherein the processor provides the at least one clearance request to the user interface.

Example 6 includes the system of Example 5, wherein the user interface displays the at least one clearance request and the user interface is configured to receive a command that directs the processor to validate the clearance request.

Example 7 includes the system of any of Examples 5-6, wherein the user interface displays the at least one clearance request to the user interface after the at least one clearance request has been validated against the dynamic information by the processor, wherein the user interface is configured to receive a command to transmit the at least one clearance request to an air traffic controller.

Example 8 includes the system of Example 7, wherein the at least one clearance request comprises multiple clearance requests that are displayed on the user interface, wherein the user interface is configured to receive a selection of one of the multiple clearance requests for transmission to the air traffic controller.

Example 9 includes the system of any of Examples 5-8, wherein the processor provides a notice that the at least one clearance request has been invalidated when the at least one clearance request has been found invalid when compared to the dynamic information.

Example 10 includes the system of any of Examples 1-9, wherein the processor is coupled to a router that routes clearance requests to a ground control upon validation.

Example 11 includes the system of any of Examples 1-10, further comprising at least one source of static information coupled to the processor, wherein the static information is information that does not change during the course of the flight, wherein the processor validates the clearance request against the static information.

Example 12 includes the system of any of Examples 1-11, wherein the processor calculates a new clearance request when the clearance request is invalidated when compared against the dynamic information.

Example 13 includes a method for validating clearance requests, the method comprising: receiving at least one clearance request that identifies a deviation from a flight path of an aircraft; validating the at least one clearance request against dynamic information received from at least one source of dynamic information on a processor executing a controller pilot data link communication application, wherein the dynamic information comprises data relevant to possible flight paths of an aircraft, the dynamic information being changeable during the flight of the aircraft.

Example 14 includes the method of Example 13, wherein validating the at least one clearance request comprises determining that the deviation from the flight plan is allowed in light of the dynamic information.

Example 15 includes the method of any of Examples 13-14, wherein receiving the at least one clearance request comprises at least one of receiving a clearance request from a user through a user interface coupled to the processor or calculating a clearance request based on static information and the dynamic information.

Example 16 includes the method of any of Examples 13-15, wherein validating the clearance request further comprises receiving an instruction from a user interface to validate the at least one clearance request against the dynamic information.

Example 17 includes the method of any of Examples 13-16, further comprising transmitting a validated clearance request to an air traffic controller, wherein a validated clearance request is an acceptable deviation when compared against the dynamic information.

Example 18 includes the method of any of Examples 13-17, further comprising providing a notice of an invalid clearance request when the at least one clearance request has been invalidated when compared to the dynamic information.

Example 19 includes the method of Example 18, further comprising calculating a new clearance request when the at least one clearance request is invalidated when compared against the dynamic information, wherein the new clearance request considers an economic point of view.

Example 20 includes a system for transmitting clearance requests to an air traffic controller, the system comprising: at least one source of dynamic information, the dynamic information comprising data relevant to possible flight paths of an aircraft, wherein the dynamic information is changeable during the flight of the aircraft; a processor coupled to the at least one source of dynamic information, the processor executing a controller pilot data link communication application; a user interface coupled to the processor, wherein the processor provides a clearance request for display on the user interface, wherein the user interface is configured to receive an instruction from a user to validate the clearance request, wherein the processor validates the clearance request against the dynamic information.

Although specific embodiments have been illustrated and described herein, it will be appreciated by those of ordinary skill in the art that any arrangement, which is calculated to achieve the same purpose, may be substituted for the specific embodiments shown. Therefore, it is manifestly intended that this invention be limited only by the claims and the equivalents thereof.

What is claimed is:

1. A system, the system comprising: a processor executing a controller pilot data link communication application; at least one source of dynamic information coupled to the processor, wherein the dynamic information comprises data relevant to possible flight paths of an aircraft, the dynamic information being changeable during the flight of the aircraft, wherein the processor processes at least one flight crew provided clearance request that identifies a deviation from the present flight path and validates the at least one clearance request against the dynamic information;

wherein, when the at least one clearance request is deemed valid when compared against the dynamic information, the at least one clearance request is sent without further input from a user to an air traffic control center to request an associated clearance.

2. The system of claim 1, wherein the at least one source of dynamic information comprises at least one of: ADS-B data; temporary flight restriction data; traffic-alert and collision avoidance system information; a digital notice to airman; digital flight information services; digital terminal weather information for pilots; weather forecast; a digital automatic terminal information service; or a current flight plan.

3. The system of claim 2, wherein the at least one source of dynamic information comprises the ADS-B data, wherein a communications management unit is configured to form a CPDLC message to communicate the ADS-B data to an air traffic controller.

4. The system of claim 1, wherein validating the at least one clearance request comprises determining that the deviation from the flight plan is allowed in light of the dynamic information.

5. The system of claim 1, further comprising a user interface coupled to the processor, wherein the processor provides the at least one clearance request to the user interface.

6. The system of claim 5, wherein the user interface displays the at least one clearance request and the user interface is configured to receive a command that directs the processor to validate the clearance request.

7. The system of claim 5, wherein the user interface displays the at least one clearance request to the user interface after the at least one clearance request has been validated against the dynamic information by the processor.

8. The system of claim 7, wherein the at least one clearance request comprises multiple clearance requests that are displayed on the user interface.

9. The system of claim 5, wherein the processor provides a notice that the at least one clearance request has been invalidated when the at least one clearance request has been found invalid when compared to the dynamic information.

10. The system of claim 1, wherein the processor is coupled to a router that routes clearance requests to a ground control upon validation.

11. The system of claim 1, further comprising at least one source of static information coupled to the processor, wherein the static information is information that does not change during the course of the flight, wherein the processor validates the clearance request against the static information.

12. The system of claim 1, wherein the processor calculates a new clearance request when the clearance request is invalidated when compared against the dynamic information.

13. A method for validating clearance requests, the method comprising: receiving at least one clearance request, from a flight crew, that identifies a deviation from a flight path of an aircraft; validating the at least one clearance request against dynamic information received from at least one source of dynamic information on a processor executing a controller pilot data link communication application, wherein the dynamic information comprises data relevant to possible flight paths of an aircraft, the dynamic information being changeable during the flight of the aircraft; wherein, when the at least one clearance request is deemed valid when compared against the dynamic information, the at least one clearance request is sent without further input from a user to an air traffic control center to request an associated clearance.

14. The method of claim 13, wherein validating the at least one clearance request comprises determining that the deviation from the flight plan is allowed in light of the dynamic information.

15. The method of claim 13, wherein receiving the at least one clearance request comprises at least one of receiving a clearance request from a user through a user interface coupled to the processor or calculating a clearance request based on static information and the dynamic information.

16. The method of claim 13, wherein validating the clearance request further comprises receiving an instruction from a user interface to validate the at least one clearance request against the dynamic information.

17. The method of claim 13, further comprising transmitting a validated clearance request to an air traffic controller, wherein a validated clearance request is an acceptable deviation when compared against the dynamic information.

18. The method of claim 13, further comprising providing a notice of an invalid clearance request when the at least one clearance request has been invalidated when compared to the dynamic information.

19. The method of claim 18, further comprising calculating a new clearance request when the at least one clearance request is invalidated when compared against the dynamic information, wherein the new clearance request considers an economic point of view.

20. A system for transmitting clearance requests to an air traffic controller, the system comprising:

at least one source of dynamic information, the dynamic information comprising data relevant to possible flight paths of an aircraft, wherein the dynamic information is changeable during the flight of the aircraft;

a processor coupled to the at least one source of dynamic information, the processor executing a controller pilot data link communication application; and a user interface coupled to the processor, wherein the processor provides a clearance request from a flight crew for display on the user interface, wherein the user interface is configured to receive an instruction from a user to validate the clearance request, wherein the processor validates the clearance request against the dynamic information; wherein, when the clearance request is deemed valid when compared against the dynamic information, the at least one clearance request is sent without further input from a user to an air traffic control center to request an associated clearance.

* * * * *